US006244584B1

(12) United States Patent
Holbrook et al.

(10) Patent No.: US 6,244,584 B1
(45) **Date of Patent: *Jun. 12, 2001**

(54) HIGH SPEED PNEUMATIC DOCUMENT INPUT SYSTEM

(75) Inventors: Russell W. Holbrook, Southbury; William J. Wright, Killingworth; Karel J. Janatka, Southbury; Robert J. Allen, Danbury, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/212,660

(22) Filed: Dec. 16, 1998

(51) Int. Cl.[7] ..... B65H 5/22

(52) U.S. Cl. ..... 271/3.07; 271/3.05; 271/3.01; 270/52.09; 270/52.12

(58) Field of Search ..... 270/58.06, 52.08, 270/52.09, 52.17, 52.12; 271/3.01, 225, 109, 98, 94, 11, 3.05, 3.07, 3.08, 3.11

(56) References Cited

U.S. PATENT DOCUMENTS

| | | | | |
|---|---|---|---|---|
| 4,034,973 | * | 7/1977 | Hams | 270/21 |
| 4,269,405 | | 5/1981 | Mitzel | 271/94 |
| 4,320,893 | | 3/1982 | Blumle | 271/94 |
| 4,456,127 | * | 6/1984 | Hams | 270/52.09 |
| 4,502,676 | * | 3/1985 | Stocker | 270/52.09 |
| 4,579,330 | | 4/1986 | Lehmann | 271/11 |
| 4,787,619 | | 11/1988 | Fuss et al. | 271/98 |
| 4,939,888 | * | 7/1990 | Katz et al. | 270/52.09 |
| 5,072,922 | | 12/1991 | Paulson | 271/11 |
| 5,088,717 | | 2/1992 | Hamanaka et al. | 271/98 |
| 5,104,104 | * | 4/1992 | Mol | 270/52.5 |
| 5,642,878 | | 7/1997 | Smithe et al. | 271/109 |
| 5,649,698 | * | 7/1997 | Auerbach et al. | 271/225 |
| 5,947,461 | * | 9/1999 | Holbrook et al. | 270/52.09 |

OTHER PUBLICATIONS

Co–pending commonly assigned patent applications having Attorney Docket Numbers E–769 and E–787 filed on the same date herewith.

Co–pending commonly assigned patent application having Ser. No. 08/917,161 filed on Aug. 25, 1997.

* cited by examiner

*Primary Examiner*—Christopher P. Ellis
*Assistant Examiner*—Patrick Mackey
(74) *Attorney, Agent, or Firm*—Christopher J. Capelli; Michael E. Melton

(57) ABSTRACT

The present invention relates to an input system for feeding one-up sheets from a paper web to a high speed mass mailing inserter system. The input system includes a feeding module for supplying a paper web having two web portions in side-by-side relationship. A merging module is located downstream in the path of travel from the feeding module and is operational to feed the two web portions in an upper-lower relationship so as to reorient the paper web from the side-by-side relationship to an upper-lower relationship. A separating module is located downstream in the path of travel from the merging module and is operational to receive the paper web in the upper-lower relationship and separate the paper web into individual two-up sheets. In order to separate the two-up sheets into one-up sheets, a stacking module is located downstream in the path of travel from the separating module and is configured to receive the two-up sheets, stack the two-up sheets and individually feed one-up sheets from the stack.

18 Claims, 12 Drawing Sheets

314
471
402
335
335
416
404
408
410
418
424
430
420
424
426
428
406
422
434
432
430

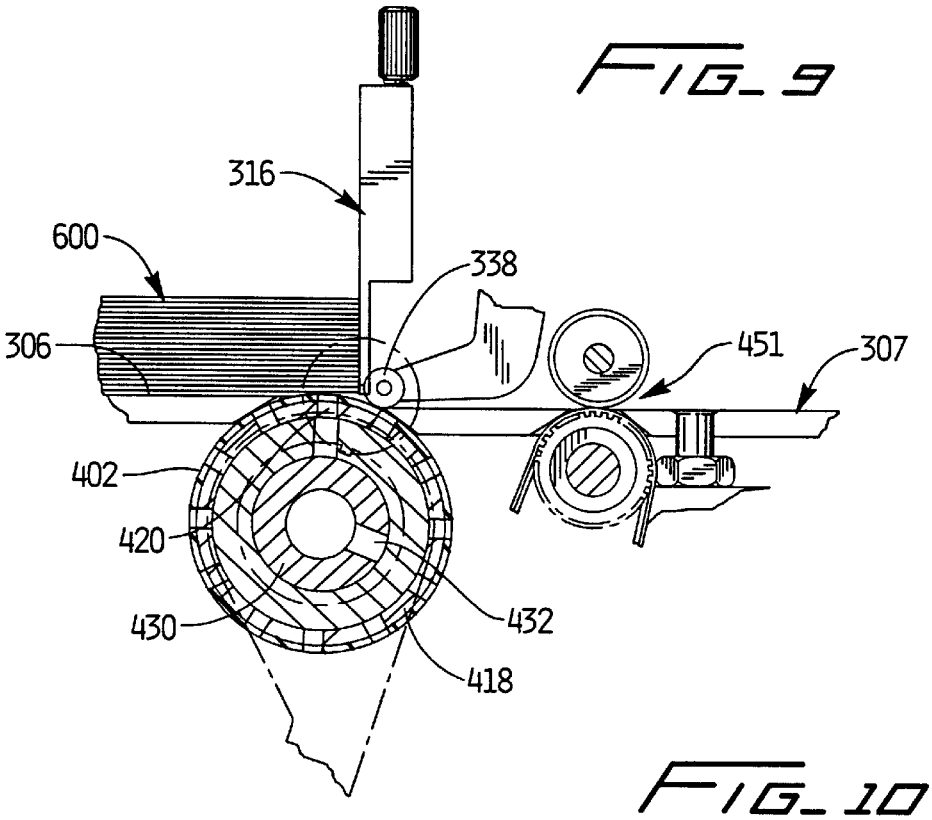
FIG_9
FIG_10
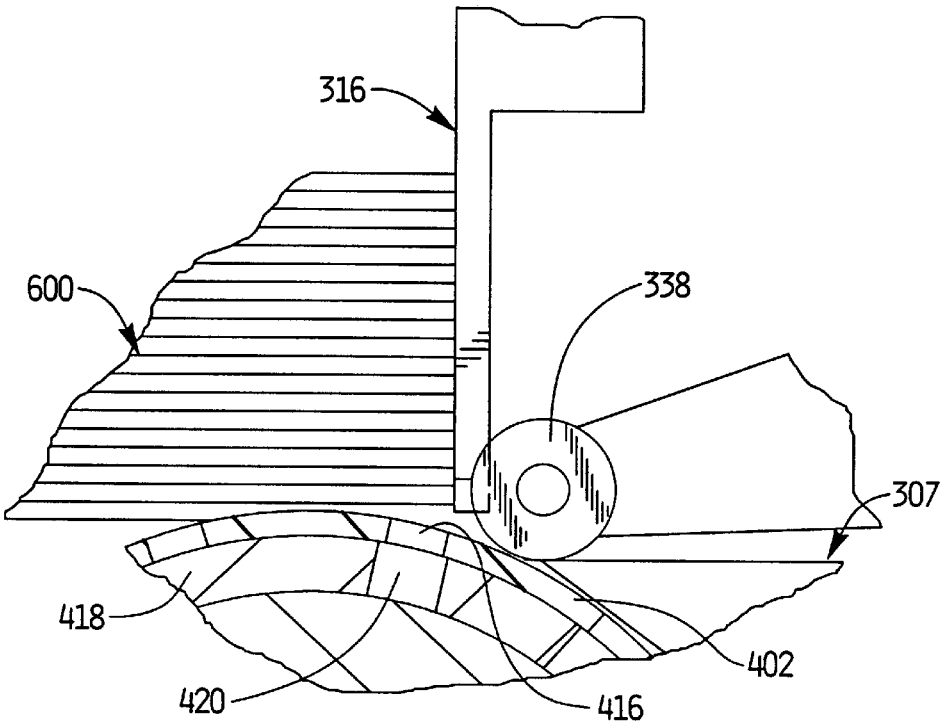

HIGH SPEED PNEUMATIC DOCUMENT INPUT SYSTEM

FIELD OF THE INVENTION

The present invention relates generally to multi-station document inserting systems, which assemble batches of documents for insertion into envelopes. More particularly, the present invention is directed towards the input system for providing documents at a high speed to such multi-station document inserting systems.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation.

For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to a cutter or burster station for individually separating documents from the web. A control scanner is typically located in the cutting or bursting station for sensing the control marks on the control documents. According to the control marks, these individual documents are accumulated in an accumulating station and then folded in a folding station. Thereafter, the serially arranged insert feeder stations sequentially feed the necessary documents onto a transport deck at each insert station as the control document arrives at the respective station to form a precisely collated stack of documents which is transported to the envelope feeder-insert station where the stack is inserted into the envelope. A typical modem inserter system also includes a control system to synchronize the operation of the overall inserter system to ensure that the collations are properly assembled.

In order for such multi-station inserter systems to process a large number of mailpieces (e.g., 18,000 mailpieces an hour) with each mailpiece having a high page count collation (at least five (5) pages), it is imperative that the input system of the multi-station inserter system is capable of cycling input documents at extremely high rates (e.g. 72,000 per hour). However, currently there are no commercially available document inserter systems having an input system with the capability to perform such high speed document input cycling. Regarding the input system, existing document inserter systems typically first cut or burst sheets from a web so as to transform the web into individual sheets. These individual sheets may be either processed in a one-up format or merged into a two-up format, typically accomplished by center-slitting the web prior to cutting or bursting into individual sheets. A gap is then generated between the sheets (travelling in either in a one-up or two-up format) to provide proper page breaks enabling collation and accumulation functions. After the sheets are accumulated, they are folded and conveyed downstream for further processing. As previously mentioned, it has been found that this type of described input system is either unable to, or encounters tremendous difficulties, when attempting to provide high page count collations at high cycling speeds.

Therefore, it is an object of the present invention to overcome the difficulties associated with input stations for console inserter systems when providing high page count collations at high cycling speeds.

SUMMARY OF THE INVENTION

The present invention provides a system and method for inputting documents in a high speed inserter system to achieve high page count collations. More particularly, the present invention provides for collecting, stacking and re-feeding individual documents after they are fed from a web supply and separated in a cutting station, preparatory to collation and accumulation of the individual documents.

In accordance with the present invention, the input system includes a feeding module for supplying a paper web having the two web portions in side-by-side relationship. A merging module is located downstream in the path of travel from the feeding module and is operational to feed the two web portions in upper-lower relationship so as to reorient the paper web from the side-by-side relationship to an upper-lower relationship. A separating module is located downstream in the path of travel from the merging module and is operational to receive the paper web in the upper-lower relationship and separate the paper web into individual two-up sheets. In order to separate the two-up sheets into one-up sheets, a stacking module is located downstream in the path of travel from the separating module and is configured to receive the two-up sheets, stack the two-up sheets in a sheet pile and individually feed one-up sheets from the stack.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which:

FIG. 9 is a partial side planar view, in partial cross-section, of the sheet feeder of FIG. 4 depicting the valve drum in its non-sheet feeding default position;

FIG. 10 is a partial enlarged view of FIG. 9;

DETAILED DESCRIPTION OF THE PREFERRED EMBODIMENT

Figure 1:
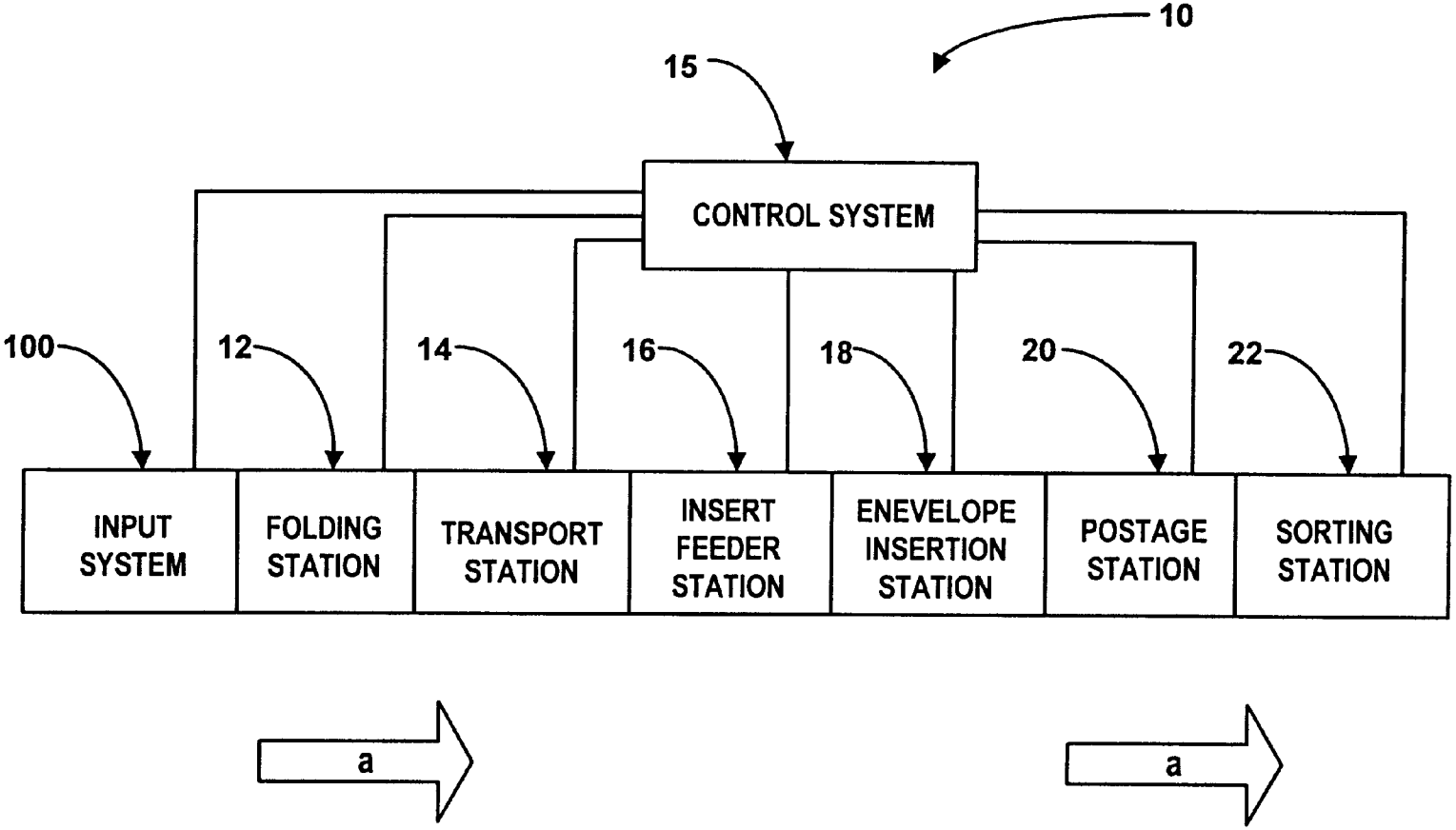
FIG. 1 is a block diagram schematic of a document inserting system in which the present invention input system is incorporated.

In describing the preferred embodiment of the present invention, reference is made to the drawings, wherein there is seen in FIG. 1 a schematic of a typical document inserting system, generally designated 10, which implements the present invention input system 118. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below system 10 preferably includes an input system 118 that feeds paper sheets from a paper web to an accumulating station that accumulates the sheets of paper in collation packets. Preferably, only a single sheet of a collation is coded (the control document), which coded information enables the control system 15 of inserter system 10 to control the processing of documents in the various stations of the mass mailing inserter system. The code can comprise a bar code, UPC code or the like.

Essentially, input system 118 feeds sheets in a paper path, as indicated by arrow "a," along what is commonly termed the "main deck" of inserter system 10. After sheets are accumulated into collations by input system 118, the collations are folded in folding station 12 and the folded collations are then conveyed to a transport station 14, preferably operative to perform buffering operations for maintaining a proper timing scheme for the processing of documents in inserting system 10.

Each sheet collation is fed from transport station 14 to insert feeder station 16. It is to be appreciated that a typical inserter system 10 includes a plurality of feeder stations, but for clarity of illustration only a single insert feeder 16 is shown. Insert feeder station 16 is operational to convey an insert (e.g., an advertisement) from a supply tray to the main deck of inserter system 10 so as to be nested with the aforesaid sheet collation being conveyed along the main deck. The sheet collation, along with the nested insert(s) are next conveyed into an envelope insertion station 18 that is operative to insert the collation into an envelope. The envelope is then preferably conveyed to postage station 20 that applies appropriate postage thereto. Finally, the envelope is preferably conveyed to sorting station 22 that sorts the envelopes in accordance with postal discount requirements.

As previously mentioned, inserter system 10 includes a control system 15 coupled to each modular component of inserter system 10, which control system 15 controls and harmonizes operation of the various modular components implemented in inserter system 10. Preferably, control system 15 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: folding station 12, transport station 14, insert feeder station 16, envelope insertion station 18, postage station 20 and sorting station 22) form no part of the present invention input system 118, further discussion of each of these stations is also not described in detail in order not to obscure the present invention. Moreover, it is to be appreciated that the depicted embodiment of inserter system 10 implementing the present invention input system 118 is only to be understood as an example configuration of such an inserter system 10. It is of course to be understood that such an inserter system may have many other configurations in accordance with a specific user's needs.

Figure 2:
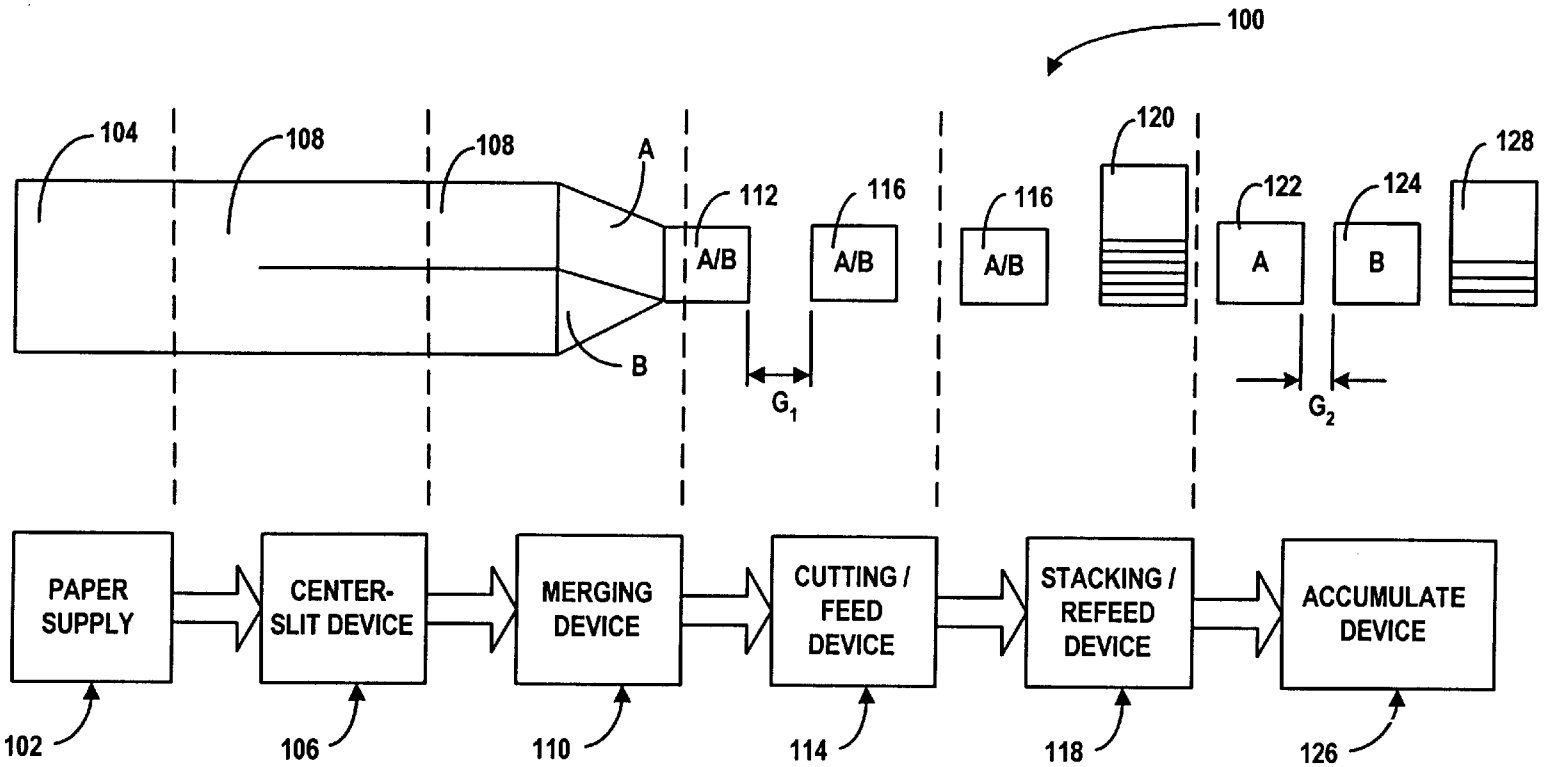
FIG. 2 is a block diagram schematic of the present invention input stations implemented in the inserter system of FIG. 1.

Referring now to FIG. 2, the present invention input system 118 is shown. In the preferred embodiment, insert system 118 consists of a paper supply 102, a center-slitting device 306, a merging device 110, a cutting and feed device 114, a stacking and re-feed device 118 and an accumulating device 126. Regarding paper supply device 102, it is to be understood to encompass any known device for supplying side-by-side sheets from a paper web 104 to input system 118 (i.e., enabling a two-up format). Paper supply device 102 may feed the side-by-side web 104 from a web roll, which is well known in the art. Alternatively, paper supply device 102 may feed the side-by-side web 104 from a fan-fold format, also well known in the art. As is typical, web 104 is preferably provided with apertures (not shown) along its side margins for enabling feeding into paper supply station 102, which apertures are subsequently trimmed and discarded.

A center-slit device 306 is coupled to paper supply station 102 and provides a center slitting blade operative to center slit the web 104 into side-by-side uncut sheets 108(A and B). Coupled to center-slit device 306 is a merging device 110 operative to transfer the center-slit web 108 into an upper-lower relationship, commonly referred to as a "two-up" format 112. That is, merging device 110 merges the two uncut streams of sheets A and B on top of one another, wherein as shown in FIG. 2, the left stream of uncut sheets A are positioned atop the right stream of sheets B producing a "two-up" (A/B) web 112. It is to be appreciated that even though the merging device 110 of FIG. 2 depicts the left side uncut sheets A being positioned atop the right side uncut sheets B (A/B), one skilled in the art could easily adapt merging device to position the right side uncut sheets B atop the left side A uncut sheets (B/A). An example of such a merging device for transforming an uncut web from a side-by-side relationship to an upper-lower relationship can be found in commonly assigned U.S. Pat. No. 5,104,104, which is hereby incorporated by reference in its entirety.

A cutting and feed device 114 is coupled to merging device 110 and is operative to cut the "two-up" A/B web 112 into separated "two-up" (A/B) individual sheets 116. Preferably, cutting and feed device 114 includes either a rotary or guillotine type cutting blade, which cuts the two sheets A and B atop one another 116 every cutter cycle. Preferably, the "two-up" (A/B) sheets 116 are fed from cutting and feed device 114 with a predetermined gap $G_1$ between each succession of "two-up" (A/B) collations 116 conveying downstream from cutting and feed device 114. It is to be appreciated that in order to maintain a high cycle speed for inserter system 10, the aforesaid "two-up" (A/B) web 112 is continually transported into cutting and feed device 114 at a constant velocity.

A stacking and re-feed device 118 is coupled in proximity and downstream to cutting and feed device 114 and is operative to separate the "two-up" (A/B) sheet collations 116 into individual sheets 124(A) and 126(B). Stacking and re-feed device 118 is needed since the "two-up" (A/B) web 112 is merged before being cut into individual sheets and it is necessary to separate the two-up sheets 116 into individual sheets 122(A) and 124(B) prior to further downstream processing in inserter system 10. In the present preferred embodiment, the two-up sheets 116(A and B) are separated from one another by stacking the aforesaid "two-up" (A/B) sheet collations 116 atop of one another in a stacking pile 120. Stacking and re-feed device 118 is configured to individually (e.g., in seriatim) feed one-up sheets 122, 124(A, B) from sheet stack 120. Sheet and re-feed device 118 is further configured to individually re-feed the sheets from the bottom of stack 120 with a predetermined gap $G_2$ between each successive sheet 122(A) and 124(B). This gap $G_2$ may be varied by stacking and re-feed device 118 under instruction from control system 15, which gap $G_2$ provides break-points for enabling proper accumulation in downstream accumulating device 126.

It is pointed out that another advantage afforded by stacking and re-feed device 118 is that it enables inserter system 10 to maintain a high cycle speed. That is, in order for inserter system 10 to maintain a high cycle speed (e.g., approximately 18,000 mailpieces per hour) it is essential for the input of inserter system 118 to have a considerably greater cycle speed (e.g., approximately 72,000 sheets per hour) due to resulting time requirements needed for subsequent downstream processing (e.g., collating, accumulating, folding, etc). Furthermore, stacking and re-feed device 118 enables sheets to be fed in the aforesaid two-up format 116 from a web roll at an approximately constant speed (e.g., 36,000 cuts per hour) which is also advantageous in that it is difficult to control to the rotational speed of a large web roll (especially at high speeds) for feeding sheets therefrom due to the large inertia forces present upon the web roll. The individual sheets 122, 124(A, B) are then individually fed from stack 120 at a second speed (e.g., over 250 inches per second), which second speed is greater than the input speed (e.g., approximately 117 inches per second).

Coupled downstream to the stacking and re-feed device 118 is an accumulating device 126 for assembling a plurality of individual sheets of paper into a particular desired collation packet prior to further downstream processing. In particular, accumulating device 126 is configured to receive the seriatim fed individual sheets 122 and 124 from stacking and re-feed device 118, and pursuant to instructions by control system 15, collates a predetermined number of sheets 128 before advancing that collation downstream in inserter system 10 for further processing (e.g., folding). Accumulator device 126 may collate the sheets into the desired packets either in the same or reverse order the sheets are fed thereinto. Each collation packet 128 may then be folded, stitched or subsequently combined with other output from document feedings devices located downstream thereof and ultimately inserted into a envelope. It is to be appreciated that such accumulating devices are well known in the art, an example of which is commonly assigned U.S. Pat. No. 5,083,769 hereby incorporated by reference in its entirety.

Therefore, an advantage of the present invention mass mailing input system 118 is that it: 1) center slits a web before cutting the web 108 into individual sheets 116; 2) feeds individual sheets 116 at a high speed in a two-up format to a stacking pile 120; and 3) feeds individual sheets 122, 124(A, B) in seriatim in a one-up format from the stacking pile 120 for subsequent processing in the high speed inserter system 10. As mentioned above, this system arrangement is particularly advantageous in high-speed inserter systems where it is imperative to provide input sheets at high cycle speeds. In particular, the present invention input system 118 is advantageous in that it eliminates the need for a merging device downstream of the cutting device that results in an additional operation and time. Furthermore, the stacking of individual sheets in stacking and re-feed device 118 acts as a buffer between the accumulating device 126 and the paper supply 102 and provides quick response times to a feed and gap request from the control system 15 while enabling the paper supply 102 to provide a constant feed of documents.

Figure 3:
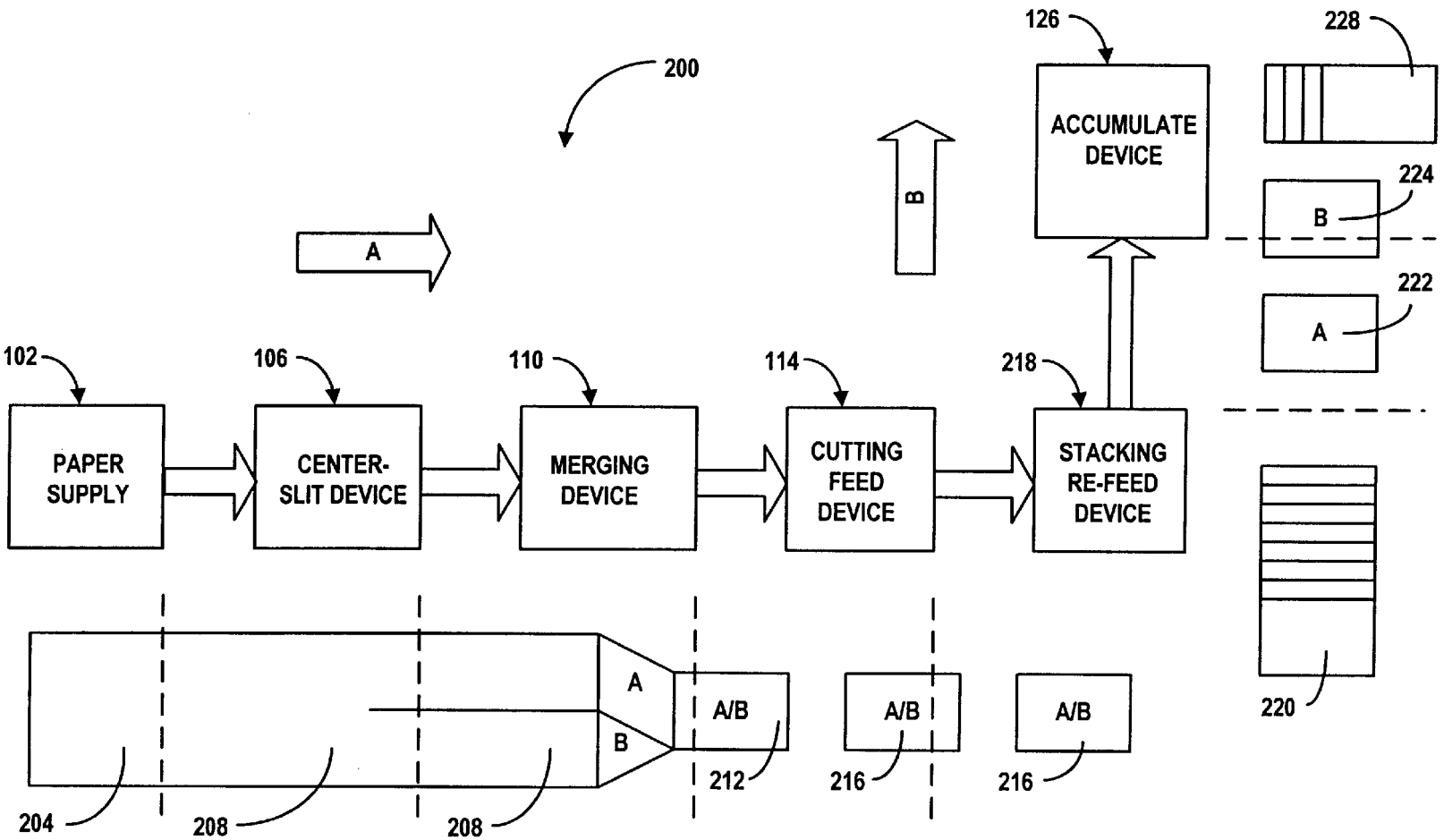
FIG. 3 is a block diagram schematic of another embodiment of the present invention input system.

Referring now to FIG. 3, there is shown an input system designated generally by reference numeral 200 that is substantial similar to the above described input system 118, wherein like reference numerals identify like objects. The difference being that stacking and re-feed device 218 of input system 200 is also configured as a "right-angle-turner." That is, stacking and re-feed device 218 changes the direction of travel for sheets 216 feeding from cutting device 114 by 90° relative to sheets 222 feeding from stacking and re-feed device 218.

In operation, and as depicted in FIG. 3, two-up sheets 216 are fed from cutting device 114 into stacking device 218 along a first direction of travel (represented by arrow "A"). As previously mentioned with regard to the stacking device 118 of input system 118, stacking device 218 stacks atop one another the two-up sheets 216 in a sheet pile 220. However, unlike the stacking device 118 of input system 118, stacking device 218 individually feeds, in seriatim, one-up sheets 222 and 224 along a second direction of travel (represented by arrow "B") oriented 90° relative to the aforesaid first direction of travel (represented by arrow "A").

An advantage of this arrangement is that sheets 216 can be fed from a paper supply 102 in a landscape orientation, whereby stacking device 218 changes the sheet orientation to a portrait orientation when sheets 222 are fed downstream from stacking device 218. Of course it is to be appreciated that the input system depicted in FIG. 3 is not to be understood to be limited to changing a sheets orientation of travel from landscape to portrait, as input system 200 may be adapted by one skilled in the art to change a sheets orientation of travel from portrait to landscape. An additionally advantage of input system 200 is that it changes the overall footprint of an inserter system, which is often required so as to suit a customers designated area that is to accommodate the inserter system.

With the input system 10 of the present invention being described above, discussion will now turn towards a preferred embodiment for the stacking and re-feed device 118 (e.g., the "sheet feeder").

Figure 4:
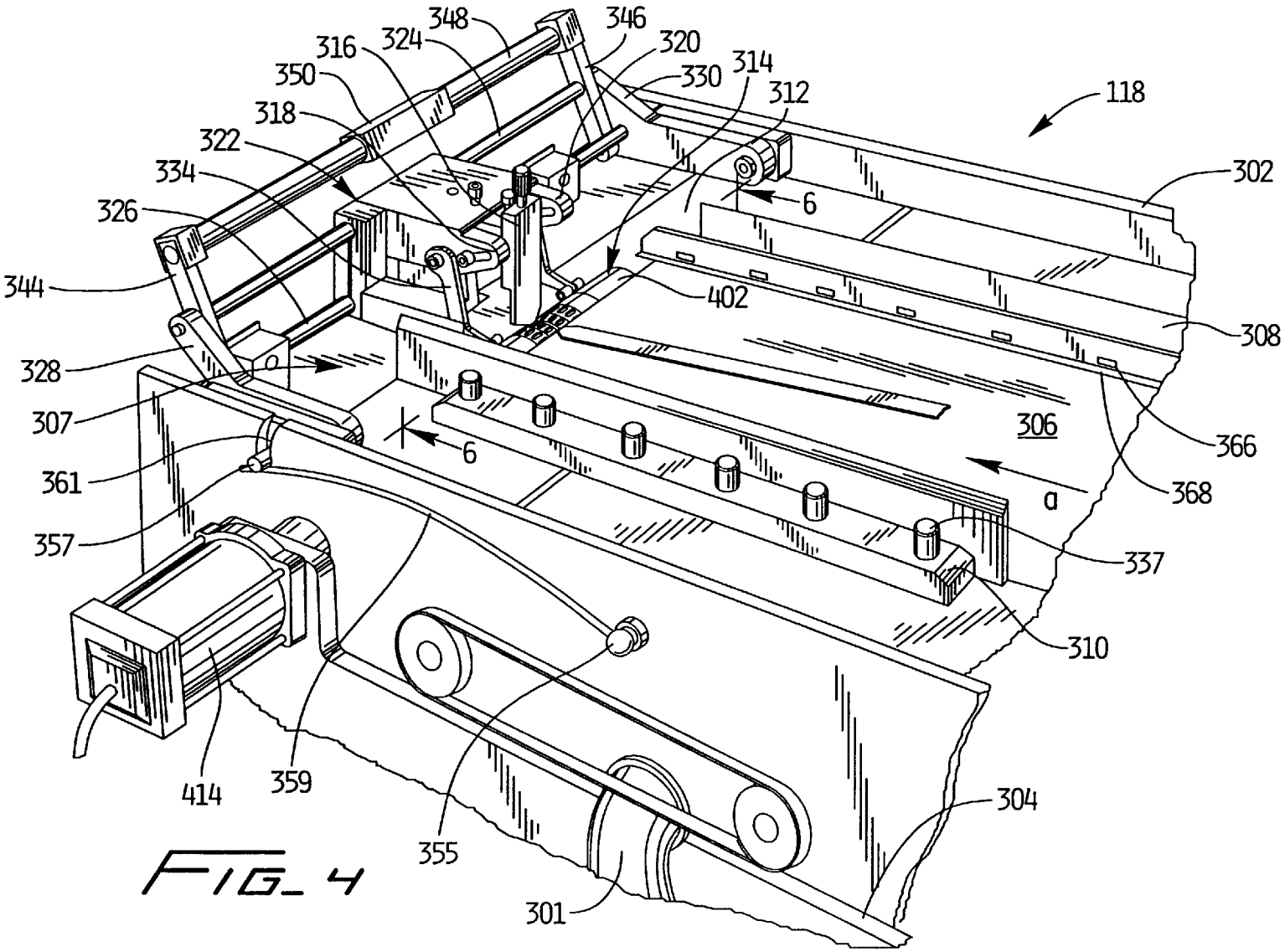
FIG. 4 is a perspective view of the upper portion of the present invention pneumatic sheet feeder.
Figure 7:
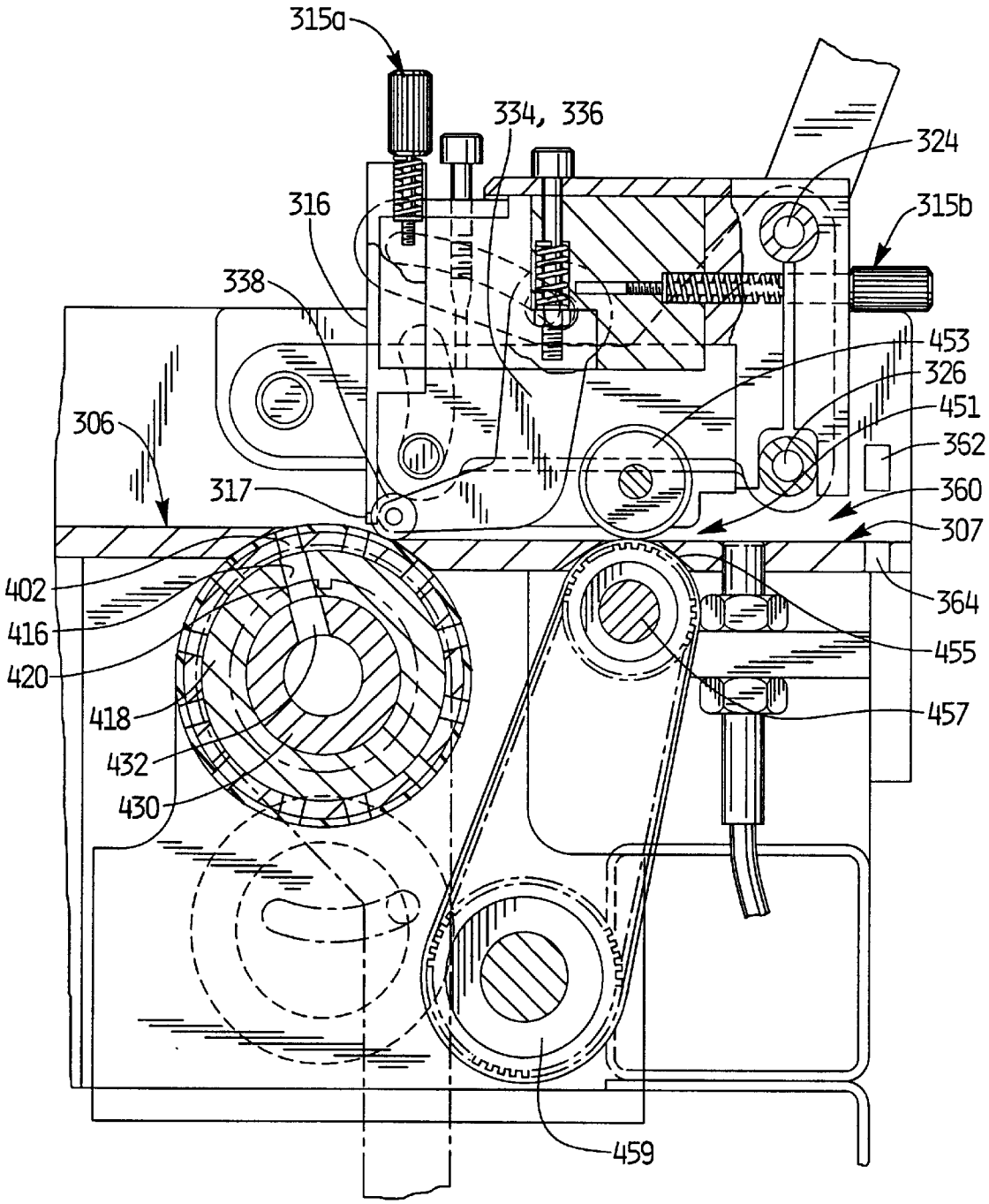
FIG. 7 is a cross-sectional view taken along line 7—7 of FIG. 6.

Referring now specifically to the sheet feeder 118 shown in FIG. 4, it includes a base frame having opposing side portions 302 and 304. A planar deck surface 306 is positioned and supported intermediate the base side portions 302 and 304. On the deck surface 306 are positioned two sheet guide rails 308, 310 that extend parallel to each other and are preferably displaceable transversely relative to each other by known means. An open slot 312 is formed on the deck 306 in which a pneumatic cylinder assembly 314 is mounted for rotation within and below a stripper plate 316 extending generally parallel with the cylinder assembly 314. The pneumatic cylinder assembly 314 includes an outer feed drum 402 that is mounted so that its top outer surface portion is substantially tangential to the top surface of the feed deck 306 and takeaway deck 307, which takeaway deck 307 is located downstream of the feed drum 402 (as best shown in FIG. 7). A more detailed description of the pneumatic cylinder assembly 314 and its operation will be provided further below.

With reference to FIG. 7, it can be seen that the outer circumference of the feed drum 402 extends between the open slot 312 formed between the angled ends of the two decks 306 and 307. The respective facing ends of the feed deck 306 and takeaway deck 307 are dimensioned (e.g., angled) so as to accommodate the outer circumference of the feed drum 402. The top portion of the outer circumference of the feed drum 402 extends above the top surfaces of both decks 306 and 307, wherein the top surface of the takeaway deck 307 resides in a plane slightly below the plane of the top surface of the feed deck 306. Preferably the takeaway deck 307 resides in a plane approximately one tenth of an inch (0.118") below the top planar surface of the feed deck 306. This difference in deck heights is chosen so as to minimize the angular distance the sheets have to travel around the feed drum 402 when feeding from the feed deck 306. By reducing this angular distance, the amount of "tail kick" associated with sheets being fed by the feed drum 402 is reduced. "Tail kick" can best be defined as the amount the trail edge of a sheet raises off the feed deck 306 as it leaves the feed drum 402. It is to be understood that "tail kick" is a function of sheet stiffness and the angle of takeaway as determined by the respective heights of the feed drum 402 and takeaway deck 307.

The stripper plate 316 is adjustably fixed between two mounting extensions 318, 320 extending from a mounting block 322. A first set screw 315*a* is received in a threaded opening in the top of the mounting block 322 for providing vertical adjustment of the stripper blade 316 relative to the deck 306 of the sheet feeder 318. A second set screw 315*b* is received in a threaded opening in the back of the mounting block 322 for providing lateral adjustment of the stripper blade 316 relative to the feed deck 306 of the sheet feeder 118.

As will be appreciated further below, the stripper blade 316 allows only one sheet to be fed at a time by creating a feed gap relative to the outer circumference of the feed drum 402, which feed gap is approximately equal to the thickness of a sheet to be fed from a sheet stack. In particular, the lower geometry of the stripper blade 316 is triangular wherein the lower triangular vertex 317 of the stripper blade 316 is approximately located at the center portion of the sheets disposed on the deck 306 as well as the center of the rotating feed drum 402. An advantage of the triangular configuration of the lower vertex 317 of the stripper blade 316 is that the linear decrease in the surface area of stripper blade 316 at its lower vertex 317 provides for reduced friction which in turn facilitates the feeding of sheets beneath the lower vertex 317 of the stripper blade 316. Preferably, it is at this region just beneath the lower vertex 317 of the stripper blade 316 in which resides a metal band 410 positioned around the outer circumference of the feed drum 402 (FIG. 5), (and preferably in the center portion of the feed drum 402) which metal band 410 acts as a reference surface for the position of the lower vertex of the stripper blade 316 to be set in regards to the feed drum 402. This is particularly advantageous because with the hard surface of the metal band 410 acts as a reference, a constant feed gap between the lower vertex 317 of the stripper blade 316 and the feed drum 402 is maintained.

Figure 5:
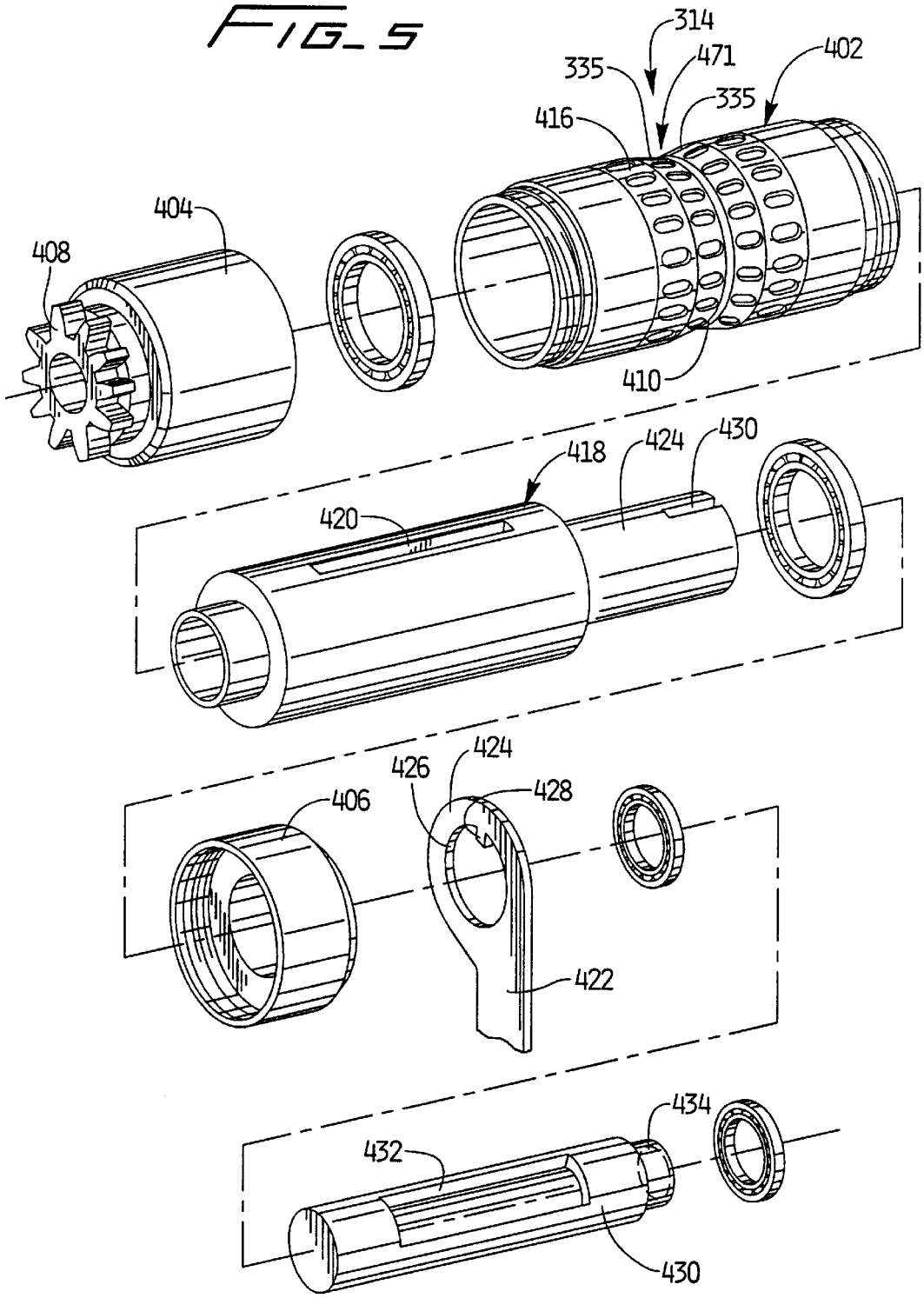
FIG. 5 is a perspective exploded view of the pneumatic cylinder assembly of the sheet feeder of FIG. 4.

With continuing reference to FIG. 5, the center portion of the feed drum 402 is provided with a recessed portion 471 preferably in a triangular configuration dimensioned to accommodate the lower triangular vertex 317 of the stripper blade 316. Thus, the stripper blade 316 is positioned such that its lower triangular vertex 317 resides slightly above the recessed portion 471 of the feed drum 402 and is preferably separated therefrom at a distance substantially equal to the thickness of a sheet to be fed from a sheet stack residing on the feed deck 306 of the sheet feeder 118. As can also be seen in FIG. 4, the metal band 410 is preferably located in the lower vertex of the of the recessed portion 471 formed in the outer circumference of the feed drum 402. It is to be appreciated that an advantage of this formation of the recessed portion 471 in the feed drum 402 is that it facilitates the separation of the lower most sheets (by causing deformation in the center portion of a lowermost sheet) from the sheet stack 600 residing on the deck 306 of the sheet feeder 118.

Figure 11:
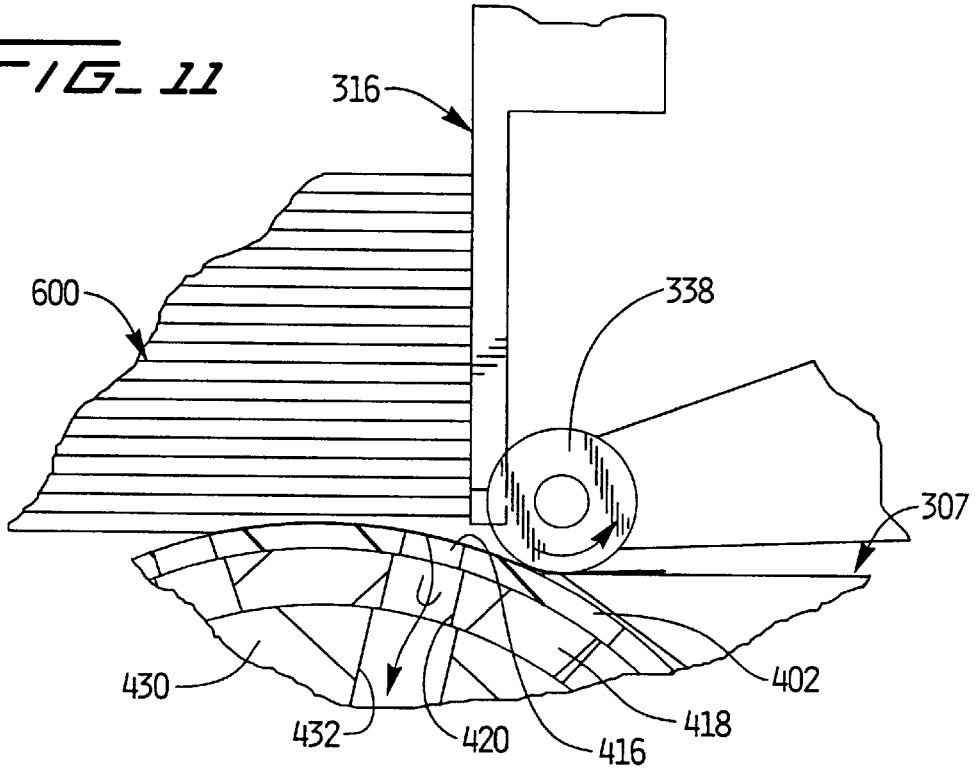
FIGS. 11 and 12 are partial enlarged views depicting a sheet feeding through the sheet feeder assembly of FIG. 4.

Also extending from the mounting block 322 are two drive nip arms 334, 336 each having one end affixed to the mounting block 322 while the other end of each opposing arm 334, 336 is rotatably connected to a respective "takeaway" nip 338. Each takeaway nip 338 is preferably biased against the other circumference of the feed drum 402 at a position that is preferably downstream of the stripper blade 316 relative to the sheet flow direction as indicted by arrow "a" on the feed deck 306 of FIG. 4. It is to be appreciated that when sheets are being fed from the feed deck 306, each individual sheet is firmly held against the rotating feed drum 402 (as will be further discussed below). And when the sheets are removed from the feed drum 306, as best seen in FIGS. 10 and 11, the end portion of the takeaway deck 307 is provided with a plurality of projections or "stripper fingers" 333 that fit closely within corresponding radial grooves 335 formed around the outer circumference of the feed drum 402 so as to remove individual sheets from the vacuum of the feed drum 402 as the sheets are conveyed onto the takeaway deck 307. That is, when the leading edge of a sheet is caused to adhere downward onto the feed drum 402 (due to an applied vacuum, as discussed further below), the sheet is advanced by the rotation of the feed drum 402 from the feed deck 306 until the leading edge of the sheet rides over the stripper fingers 333. The stripper fingers 333 then remove (e.g., "peel") the sheet from the outer vacuum surface of the feed drum 402. Thereafter, immediately after each sheet passes over the stripper fingers 333 so as to cause that portion of the sheet conveying over the stripper fingers 333 to be removed from the vacuum force effected by outer surface of the feed drum 402, that portion of the sheet then next enters into the drive nip formed between the takeaway nips 338 and the outer surface of the feed drum 402, which nip provides drive to the sheet so as to ensure no loss of drive upon the sheets after its vacuum connection to the feed drum is terminated.

Regarding the takeaway nips 338, and as just stated, they collectively provide positive drive to each sheet that has advanced beyond the stripper fingers 333. It is noted that when sheets are advanced beyond the stripper fingers 333, the vacuum of the feed drum 402 is no longer effective for providing drive to those sheets. As such, the takeaway nips 338 are positioned slightly beyond the feed drum 402 and in close proximity to the downstream portion of the stripper fingers 333 as possible. It is noted that due to the limited space in the region near the stripper fingers 333 and the takeaway deck 307, it is thus advantageous for the takeaway nips 338 to have a small profile. Preferably, the takeaway nips 338 are radial bearings having a ⅜" diameter.

Figure 6:
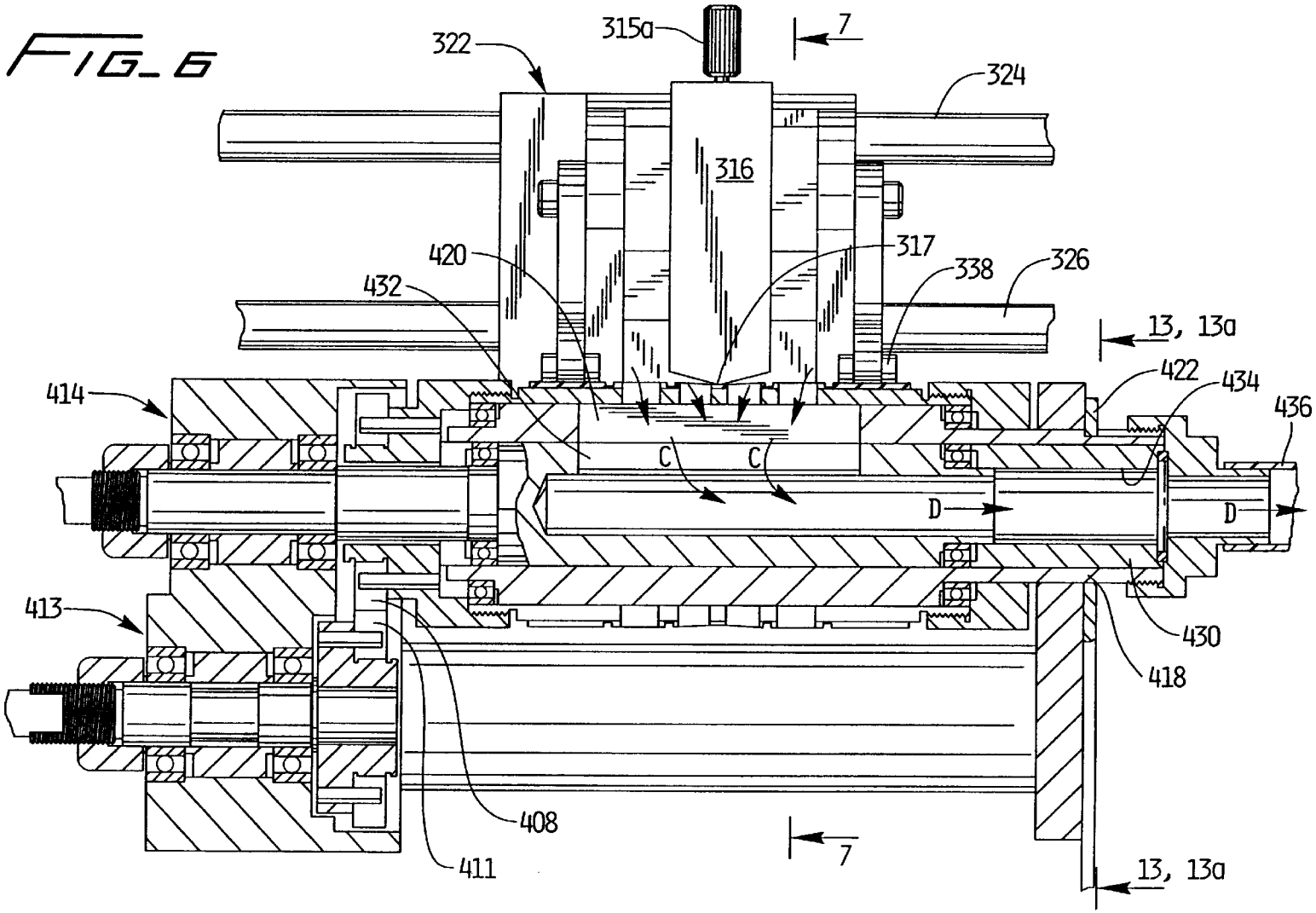
FIG. 6 is a cross-sectional view taken along line 6—6 of FIG. 4.

With reference to FIGS. 6 and 7, the mounting block 322 extends from upper and lower mounting shafts 324 and 326, wherein the lower shaft 326 extends through the mounting block 322 and has it opposing ends affixed respectively in pivoting arm members 328 and 330 (FIG. 4). Each pivoting arm member 328 and 330 has a respective end mounted to each side portion 302 and 304 of feeder 118 about a pivoting shaft 342. The other end of each pivoting arm member 328 and 330 has a respective swing arm 344, 346 pivotally connected thereto, wherein the pivot point of each swing arm 344, 346 is about the respective ends of upper shaft 324, which shaft 324 also extends through the mounting bock 322. A handle shaft 348 extends between the upper ends of the swing arms 344 and 346, wherein a handle member 350 is mounted on an intermediate portion of the handle shaft 348.

Figure 8:
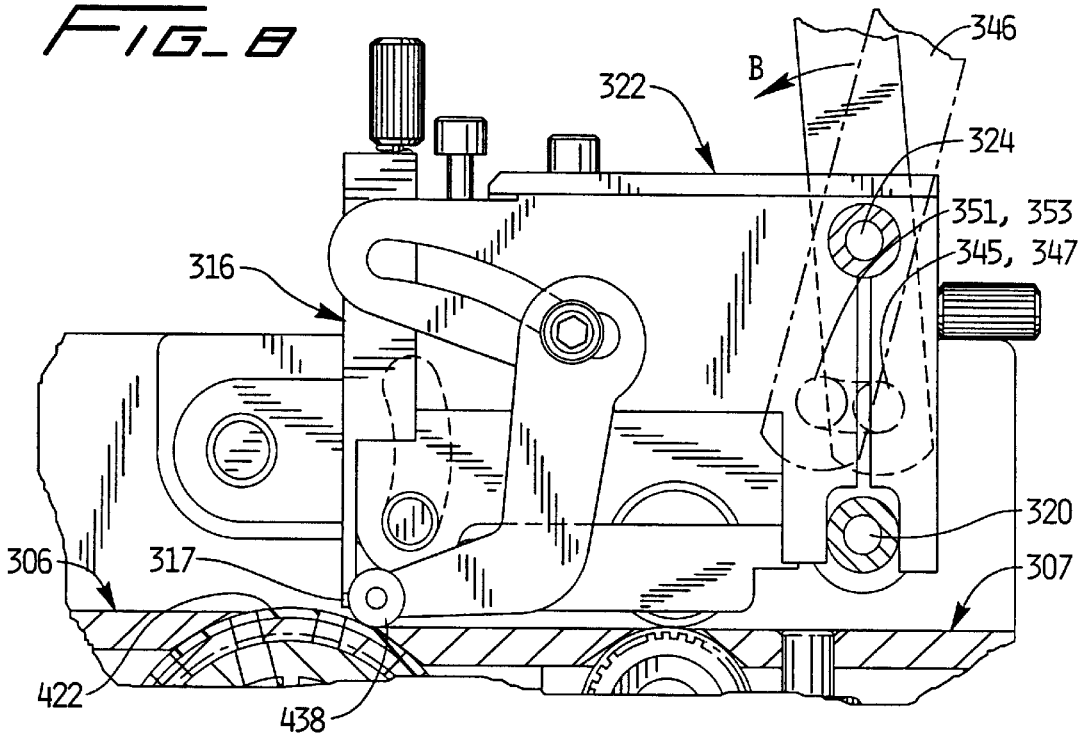
FIGS. 8 and 8*a* are partial side views of the sheet feeder of FIG. 4 depicting the mounting block in closed and open positions.
Figure 8A:
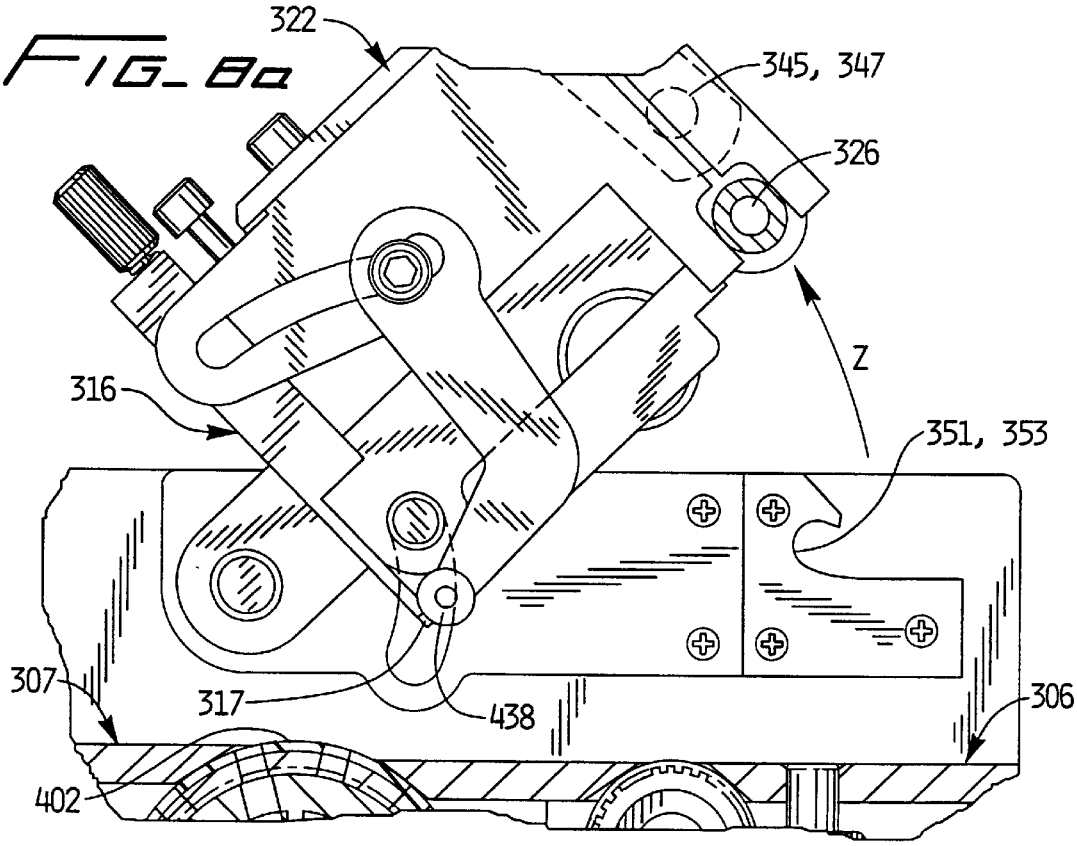

In order to facilitate the pivoting movement of the mounting block 322, and as is best shown if FIGS. 8 and 8*a*, the lower end portion of each swing arm 344, 346 is provided with a locking shaft 345, 347 that slideably extends through a grooved cutout portion (not shown) formed in the lower end portion of each pivoting arm member 328 and 330, wherein each locking shaft 345, 346 slideably receives in a grooved latch 251, 353 provided on each side 302, 304 of the sheet feeder 118 adjacent each pivoting arm member 328, 330. When each locking shaft 345, 347 is received in each respective grooved latch 351, 353 the mounting block 322 is positioned in a closed or locked positioned as shown in FIGS. 4 and 8. Conversely, when the locking shafts 345, 347 are caused to be pivoted out of their respective grooved latch 351, 353 (via pivoting movement of the two swing arms 344, 346), the mounting block 322 is caused to pivot upward and away from the deck 306 as is shown in FIG. 8*a*. As also shown in FIG. 8*a*, when the mounting block 322 is caused to be pivoted to its open position (FIG. 8*a*), the stripper blade 316 moves along a radial path (as indicated by arrow "z") so as not to intersect with the sheet stack 600 disposed on the deck 306 of the sheet feeder 118. This is particularly advantageous because when the mounting block 322 is caused to be moved to its open position (FIG. 8*a*), the sheet stack disposed on the feed deck need not be interrupted.

Providing an upward biasing force upon preferably one of the pivoting arm members 328, 330 (and in turn the mounting block 322) is an elongated spring bar 359 mounted on the outside surface of one of the side portions 304 of the sheet feeder 118. In particular, one of the ends of the spring bar 359 is affixed to a mounting projection 355 extending from the side 304 of the sheet feeder 118 wherein the other end of the spring bar 359 is caused to upwardly bias against an end portion of a spring shaft 357 extending from one of the swing arms 328 when the mounting block 322 is positioned in its closed position (FIG. 4) as mentioned above. The spring shaft 357 extends through a grooved cutout 361 formed in a side portion 304 of the sheet feeder 118 wherein the other end of the spring shaft 357 extends from one of the pivoting arm members 328. Thus, when the locking shafts 345, 347 are caused to be pivoted out of their respective grooved latch 351, 353 (via pivoting movement of the two swing arms 344, 346), the upwardly biasing force of the spring bar 359 causes the swing arms 328 to move upward, which in turn causes the mounting block 322 to pivot upward and away from the deck 306 as is shown in FIG. 8*a* due to the biasing force of the spring bar 359.

It is to be appreciated that the mounting block 322 pivots upward and away from the deck 306, and in particular the vacuum drum assembly 314 so as to provide access to the outer surface portion of the outer drum 338 for maintenance and jam access clearance purposes. With continuing reference to FIG. 4 and with reference to FIGS. 8 and 8*a*, this is effected by having the operator pivot the handle portion 350, about shaft 324, towards the deck 306 (in the direction of arrow "b" in FIG. 8*a*), which in turn causes the pivoting arm members 328 and 330 to pivot upward about respective shafts 342, which in turn causes corresponding upward pivoting movement of the mounting block 322 away from the deck 306 of the sheet feeder 118. Corresponding upward pivoting movement is effected on the mounting block 322 by pivoting arm members 328 and 330 due to that shafts 324 and 326 extend through the mounting block 322, wherein the ends are affixed in respective swing arms 344 and 346, which are respectively connected to pivoting arm members 328 and 330.

As shown in FIG. 7, downstream of the drive nips 338 is provided an electronic sensor switch 360 in the form of a light barrier having a light source 362 and a photoelectric 364. The electronic sensor switch 360 is coupled to the inserter control system 15 (FIG. 1) and as will be discussed further below detects the presence of sheets being fed from the sheet feeder 118 so as to control its operation thereof in accordance with a "mail run job" as prescribed in the inserter control system 15. Also provided downstream of the dive nips 338 is preferably a double detect sensor (not shown) coupled to the control system 15 and being operative to detect for the presence of fed overlapped sheets for indicating an improper feed by the sheet feeder 118.

With continued reference to FIG. 7, sheet feeder 118 is provided with a positive drive nip assembly 451 located downstream of the takeaway nips 338 and preferably inline with the center axis of the takeaway deck 307 (which corresponds to the center of the feed drum 402). The drive nip assembly 451 includes an idler roller 453 extending from the bottom portion of the mounting block 322 which provides a normal force against a continuously running drive belt 455 extending from a cutout provided in the takeaway deck 307. The drive belt 455 wraps around a first pulley 457 rotatably mounted below the takeaway deck 307 and a second pulley 459 mounted within the sheet feeder 118. The second pulley 459 is provided with a gear that intermeshes with a gear provided on motor 413 (FIG. 6) for providing drive to the drive belt 455. Preferably, and as will be further discussed below, motor 413 provides constant drive to the drive belt 455 wherein the drive nip 451 formed between the idler roller 453 and drive belt 455 on the surface of takeaway deck 307 rotates at a speed substantially equal to the rotational speed of the feed drum 402 (due to the feed drums 402 connection to motor 413). Thus, the drive nip assembly 451 is operational to provide positive drive to a sheet when it is downstream of the takeaway nips 338 at a speed equal, or preferably slightly greater (due to gearing), than the rotational speed of the feed drum 402.

With returning reference to FIG. 4, the side guide rails 308 and 310 are preferably spaced apart from one another at a distance approximately equal to the width of sheets to be fed from the deck 306 of the sheet feeder 118. Each side guide rail 308, 310 is provided with a plurality spaced apart air nozzles 366, each nozzle 366 preferably having its orifice positioned slightly above thin strips 368 extending along rails 308 and 310 on the top surface of the feed deck 306. The air nozzles 366 are arranged on the inside surfaces of the guide rails 308 and 310 facing each other of rails 308 and 310, which are provided with valves (not shown) that can be closed completely or partly through manually actuated knobs 337. It is to be understood that each rail 308 and 310 is connected to an air source (not shown), via hose 301, configured to provide blown air to each air nozzle 366.

Referring now to the pneumatic cylinder assembly 314, and with reference to FIGS. 4–7, the pneumatic cylinder assembly 314 includes the feed drum 402 having opposing end caps 404, 406. Each end cap 404, 406 is preferably threadingly engaged to the end portions of the feed drum 402 wherein the end of one of the end caps 404 is provided with a gear arrangement 408 for providing drive to the feed drum 402. Preferably the gear 408 of the end cap 404 inter-meshes with a gear 411 associated with an electric motor 413 mounted on the side 304 of the sheet feeder 118 for providing drive to the feed drum 402. Positioned between the end caps 404, 406 and the outer surface of the feed drum 402 is a metal band 410 wherein the outer surface of the metal band 410 is substantially planar with the outer surface, preferably in the recessed portion 471, of the feed drum 402, the functionality of which was described above in reference to the setting of the stripper plate 316 relative to the feed drum 402.

Regarding the feed drum 402, it is preferably provided with a plurality of radial aligned suction openings 416 arranged in rows. The outer surface of the feed drum 402 is preferably coated with a material suitable for gripping sheets of paper such as mearthane. The outer surface of the feed drum 402 is mounted in manner so as to be spaced from the lower vertex 317 of the stripper plate 316 by a thickness corresponding to the individual thickness of the sheets. Additionally it is to be appreciated, as will be further discussed below, when feeder 118 is in use, the feed drum 402 is continuously rotating in a clockwise direction relative to the stripper blade 316. Preferably, the feed drum 402 rotates at a speed sufficient to feed at least twenty (20) sheets a second from a sheet stack disposed on the deck 306 of feeder 118.

Slideably received within the feed drum 402 is a hollowed cylindrical vacuum drum vane 418. The vacuum drum vane 418 is fixedly mounted relative to the feed drum 402 and is provided with a elongate cutout 420 formed along its longitudinal axis. The drum vane 418 is fixedly mounted such that its elongate cutout 420 faces the suction openings 416 provided on the feed drum 402 preferably at a region below the lower vertex 317 of the stripper blade 316 (FIG. 7) so as to draw air downward (as indicated by arrow "c" in FIGS. 11 and 12) through the suction openings 416 when a vacuum is applied to the elongate cutout 420 as discussed further below. The vacuum drum vane 418 is adjustably (e.g., rotatable) relative to the feed drum 402 whereby the elongate cutout 420 is positionable relative to the suction openings 416 of the feed drum 402. To facilitate the aforesaid adjustablity of the drum vane 418, and with reference also to FIGS. 13 and 13*a*, an elongate vane adjuster 422 having a circular opening 426 at one of its ends is received about the circular end 424 of the drum vane 418. A key 428 is formed within the circular end 426 of the elongate vane adjuster, which receives within a corresponding key slot 430 formed in the end 424 of the drum vane 418 so as to prevent movement of the drum vane 418 when the vane adjuster 422 is held stationary. The vane adjuster 422 also is provided with a protrusion 423 extending from its side portion, which protrusion 423 is received within a guide slot 425 formed in a side portion 302 of the sheet feeder 318 for facilitating controlled movement of the vane adjuster 422 so as to adjust the drum vane 418.

Figure 13:
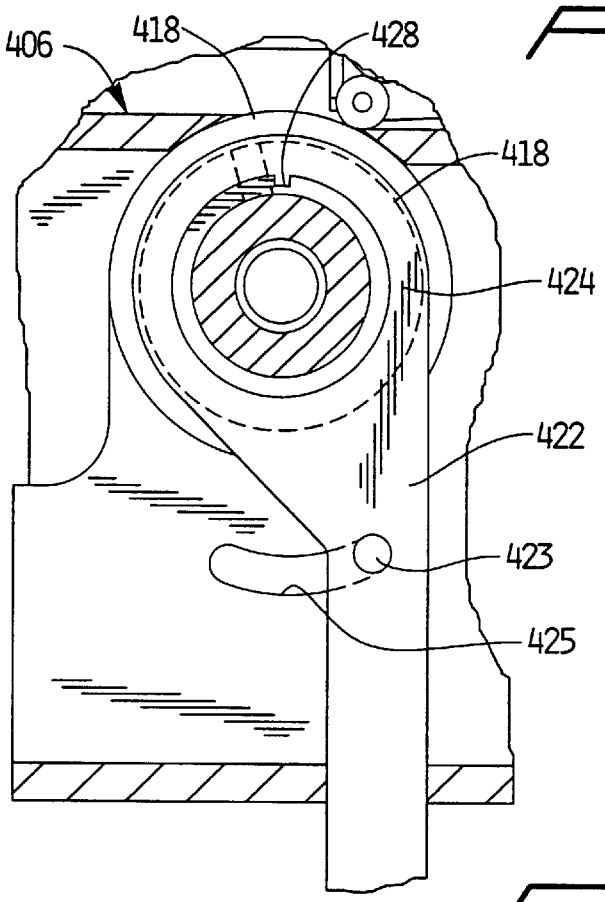
FIGS. 13 and 13*a* are partial enlarged sectional side views of the sheet feeder of FIG. 4 depicting the vane adjusting feature of the sheet feeder assembly.
Figure 13A:
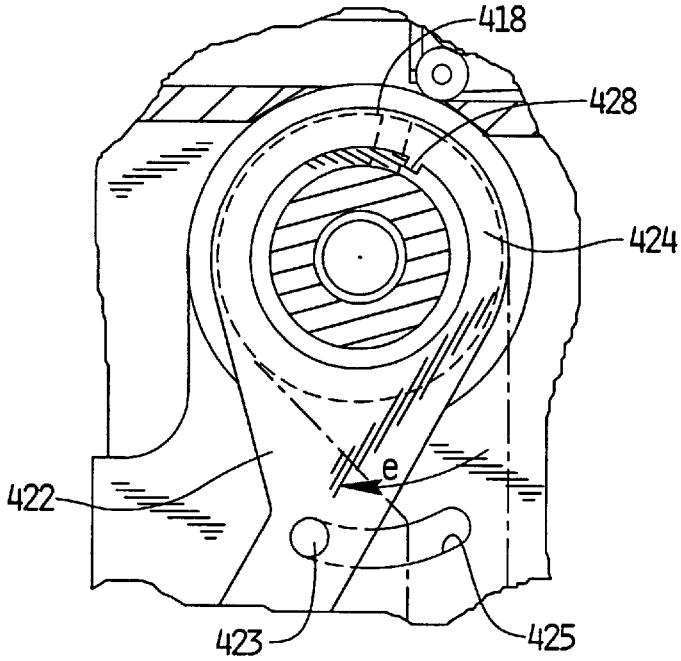

As best shown in FIGS. 13 and 13*a*, movement of the vane adjuster 422 affects corresponding rotational movement of the drum vane 418 so as to adjust the position of the elongate opening 420 relative to the suction openings 416 of the feed drum 402. Thus, when the vane adjuster 422 is caused to be moved along the direction of arrow "e" in FIG. 13*a*, the elongate opening 420 of the drum vane 418 rotates a corresponding distance. It is noted that when adjustment of the elongate cutout 420 of the drum vane 418 is not required, the vane adjuster 422 is held stationary in the sheet feeder 118 by any known locking means.

Slideably received within the fixed drum vane 418 is a hollowed valve drum 430, which is provided with an elongate cutout portion 432 along its outer surface. Valve drum 430 also has an open end 434. The valve drum 430 is mounted for rotation within the fixed drum vane 418, which controlled rotation is caused by its connection to an electric motor 414 mounted on a side portion 304 of the sheet feeder 118. Electric motor 414 is connected to the control system 15 of the inserter system 10, which control system 15 controls activation of the electric motor 414 in accordance with a "mail run job" as programmed in the control system 15 as will be further discussed below.

The open end 434 of the valve drum 430 is connected to an outside vacuum source (not shown), via vacuum hose 436, so as to draw air downward through the elongate opening 432 of the valve drum 430. It is to be appreciated that preferably a constant vacuum is being applied to the valve drum 430, via vacuum hose 436 (FIG. 6), such that when the valve drum 430 is rotated to have its elongate opening 432 in communication with the elongate opening 420 of the fixed drum vane 418 air is caused to be drawn downward through the suction openings 416 of the feed drum 402 and through the elongate openings 420, 432 of the fixed vane 418 and valve drum 430 (as indicated by arrows "c" in FIG. 6) and through the elongate opening 434 of the valve drum 430 (as indicated by arrows "d" in FIG. 6). As will be explained further below, this downward motion of air through the suction openings 416 facilitates the feeding of a sheet by the rotating feed drum 402 from the bottom of a stack of sheets disposed on the deck 306 of the feeder 118, which stack of sheets is disposed intermediate the two guide rails 308, 310. Of course when the valve drum 430 is caused to rotate such that its elongate cutout portion 432 breaks its communication with the elongate cutout 420 of the fixed vane 418, no air is caused to move downward through the suction openings 416 eventhough a constant vacuum is being applied to the valve drum 430.

With the structure of the sheet feeder 118 being discussed above, its method of operation will now be discussed. First, a stack of paper sheets 600 is disposed on the feed deck 306 intermediate the two guide rails 308, 310 such that the leading edges of the sheets forming the stack 600 apply against the stopping surface of the stripper plate 316 and that the spacing of the two guide rails 308, 310 from each other is adjusted to a distance corresponding, with a slight tolerance, to the width of the sheets. With compressed air being supplied to the spaced apart air nozzles 366 provided on each guide rail 308, 310, thin air cushions are formed between the lowermost sheets of the stack, through which the separation of the sheets from one another is facilitated and ensured.

It is to be assumed that compressed air is constantly being supplied to the air nozzles 366 of the two guide rails 308, 310 and that the feed drum 402 and drive nip assembly 451 are constantly rotating, via motor 413, while a constant vacuum force is being applied to the valve drum 430, via vacuum hose 436. When in its default position, the valve drum 430 is maintained at a position such that its elongate cutout 432 is not in communication with the elongate cutout 420 of the drum vane 418 which is fixed relative to the constant rotating feed drum 402. Thus, as shown in FIGS. 9 and 10, no air is caused to flow downward through the cutout 420 of the drum vane 418, and in turn the suction openings 416 of the feed drum 402 eventhough a constant vacuum is applied within the valve drum 430. Therefore, eventhough the feed drum 402 is constantly rotating and the leading edges of the lowermost sheet of the stack 600 is biased against the feed drum 402, the feed drum 402 is unable to overcome the frictional forces placed upon the lowermost sheet by the stack 600 so as to advance this lowermost sheet from the stack 600. Therefore, when the valve drum 430 is positioned in its default position, no sheets are fed from the stack of sheets 600 disposed on the feed deck 306 of the sheet feeder 118.

Figure 12:
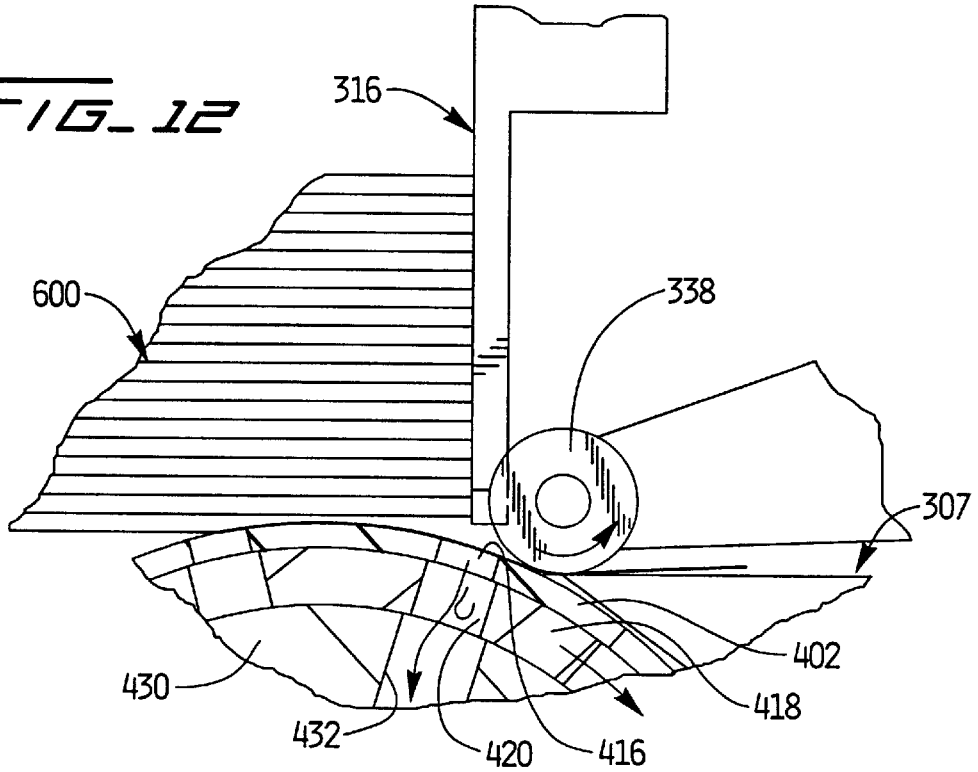

With reference to FIG. 11, when it is desired to feed individual sheets from the feed deck 306, the valve drum 430 is rotated, via motor 413, such that the elongate cutout 432 of the valve drum 430 is in communication with the elongate cutout 420 of the drum vane 418 such that air is instantly caused to be drawn downward through the suction openings 416 on the rotating feed drum 402 and through the respective elongate cutouts 420, 432 provided on the fixed drum vane 418 and the valve drum 430. This downward motion of air on the surface of the rotating feed drum 402, beneath the lower vertex 317 of the stripper plate 316, creates a suction force which draws downward the leading edge of the lowermost sheet onto the feed drum 402. This leading edge adheres against the rotating feed drum 402 and is caused to separate and advance from the sheet stack 600, which leading edge is then caused to enter into the takeaway nips 338 (FIG. 12) and then into the positive drive nip assembly 451 such that the individual sheet is conveyed downstream from the sheet feeder 318. Thus, when the valve drum 430 is rotated to its actuated position (FIGS. 11 and 12) the lowermost sheet of the stack 600 is caused to adhere onto the rotating feed drum 402, convey underneath the lower vertex 317 of the stripper plate 316, into the takeaway nips 438 and then positive drive nip assembly 451, and past the sensor 360, so as to be individual feed from the sheet feeder 118 and preferably into a coupled downstream device, such as an accumulator and/or folder 12. And as soon as the valve drum 430 is caused to be rotated to its default position (FIGS. 9 and 10), the feeding of sheets from the stack 600 is immediately ceased until once again the valve drum 430 is caused to be rotated to its actuated position (FIGS. 11 and 12).

It is to be appreciated that it is preferably the interaction between the sensor switch 360 with the control system 15 that enables the control of the sheet feeder 118. That is, when motor 414 is caused to be energized so as to rotate the valve drum 430 to its actuated position to facilitate the feeding of sheets, as mentioned above. Since the "mail run job" of the control system 15 knows the sheet collation number of every mailpiece to be processed by the inserter system 10, it is thus enabled to control the sheet feeder 118 to feed precisely the number of individual sheets for each collation corresponding to each mailpiece to be processed.

For example, if each mailpiece is to consist of a two page collation count, the motor 414 is then caused to be energized, via control system 15, so as to rotate the valve drum to its actuated position (FIG. 11) for an amount of time to cause the feeding of two sheets from the sheet feeder 118, afterwhich the motor 414 is actuated again, via control system 15, so as to rotate the valve drum 430 to its default position (FIGS. 9 and 10) preventing the feeding of sheets. As stated above, the sensor switch 360 detects when sheets are fed from the sheet feeder 118, which detection is transmitted to the control system 15 to facilitate its control of the sheet feeder 118.

Of course the sheet collation number for each mailpiece can vary whereby a first mailpiece may consist of a two page collation while a succeeding mailpiece may consist of a four page collation. In such an instance, the control system 15 causes the valve drum 430 to be maintained in its actuated position (FIG. 11) for an amount of time to enable the feeding of two sheets immediately afterwards the control system 15 then causes the valve drum 430 to be maintained in its default position (FIGS. 9 and 10) for a predefined amount of time. After expiration of this predefined amount, the control system 15 causes to valve drum 430 to be again maintained in its actuated position for an amount of time to enable the feeding of four sheets, afterwhich the above process is repeated with respect to each succeeding sheet collation number for each succeeding mailpiece to be processed in the inserter system 10.

Figure 14:
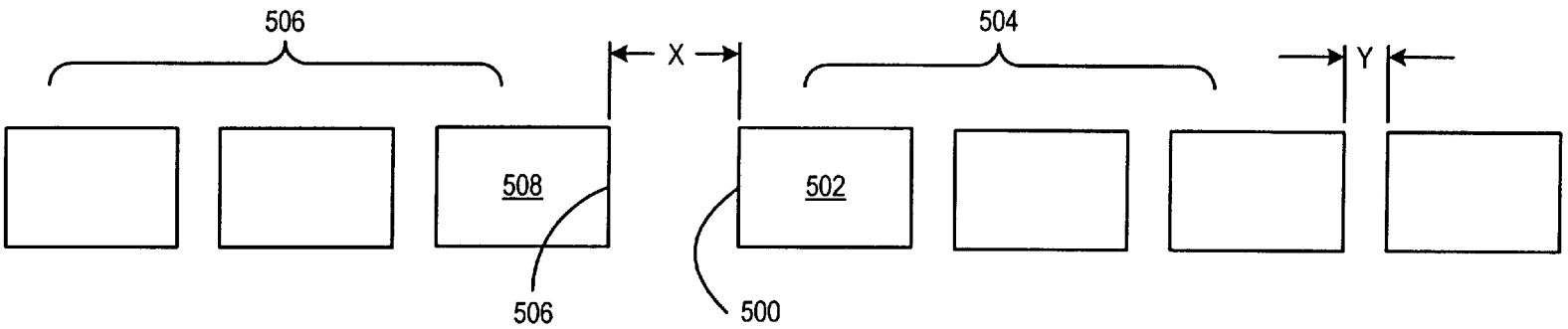
FIG. 14 is a sheet flow diagram illustrating the collation spacing provided by the sheet feeder of FIG. 4.

With reference to FIG. 14, it is noted that when the valve drum 430 is caused to be rotated and maintained in its default position (FIGS. 9 and 10), a predefined space (as indicated by arrow "x") is caused to be present between the trailing edge 500 of the last sheet 502 of a proceeding collation 504 and the lead edge 506 of the first sheet 508 of a succeeding collation 510. It is also noted that there is a predefined space (as indicated by arrow "y") between the trailing and leading edges of the sheets comprising each collation. It is to be appreciated that after the sheets are fed from the sheet feeder 118, they are then preferably conveyed to a downstream module for processing. An example of which is an accumulating station for accumulating the sheets collation so as to register their edges to enable further processing thereof, such as folding in a folding module 12. Therefore, the spacing between the trailing edge 500 of the last sheet 502 of a proceeding collation 504 and the lead edge 506 of the first sheet 508 of a succeeding collation 510 (as indicated by arrow "x") facilitates the operation of downstream module, such as an accumulating module (not shown), by providing it with sufficient time to enable the collection and processing of each collation of sheets fed from the sheet feeder 118 in seriatim.

In summary, an input system 118 for providing individual documents to a high speed mass mailing inserter system 10 has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A method for supplying individual one-up sheets to an inserter system from a paper web having at least two portions of travel comprising the steps of:

supplying a paper web having at least two portions in side-by-side relationship;

merging the at least two portions of the web from the side-by-side relationship to a substantially upper-lower relationship;

separating the upper-lower relationship paper web into individual sheets disposed atop one another;

stacking the individual sheets in a stacking pile; and feeding from the stacking pile individual one-up sheets wherein the one-up sheets can be fed in groups consisting of one or more sheets whereby each sheet in a group is in seriatim with one another and is separated from one another by a first predetermined distance.

2. A method as recited in claim 1, wherein the feeding step further includes the step of separating each sheet group from one another by a second predetermined distance.

3. A method as recited in claim 1, wherein the feeding step includes the step of feeding each sheet with a rotating feed drum.

4. A method as recited in claim 3, wherein the rotating feed drum is constantly rotating.

5. A method as recited in claim 4, further including the step of drawing a vacuum in the feed drum for causing a sheet to adhere against the rotating feed drum.

6. A method as recited in claim 4, further including the step of rotating an inner valve cylinder rotatably disposed within the feed drum between an actuated position for causing a vacuum to be drawn in the feed drum such that a sheet adheres against the rotating feed drum and a default position for terminating the vacuum being drawn in the feed drum.

7. A method as recited in claim 6, further including the step of providing a constant vacuum source to the inner valve cylinder.

8. A method as recited in claim 1 further comprising the step:

accumulating a predetermined number of one-up sheets in a sheet collation.

9. A method as recited in claim 1, wherein the merging step includes the step of center-slitting the paper web having the at least two web portions in side-by-side relationship.

10. A method as recited in claim 1, wherein the separating step includes the step of cutting the upper-lower relationship paper web into individual two-up sheets.

11. An input system for supplying individually one-up sheets to an inserter system from a paper web having at least two portions of travel, the input system comprising:

a feeding module for supplying the paper web having the at least two web portions in a side-by-side relationship;

a merging module located downstream in the path of travel from the feeding module for feeding the at least two paper web portions in upper-lower relationship so as to reorient the paper web from side-by-side to upper-lower relationship;

a separating module located downstream in the path of travel from the merging module for receiving the paper web in the upper-lower relationship and separating the paper web into individual sheets in an upper-lower relationship; and a stacking module located downstream in the path of travel from the separating module, the stacking module having an upstream side and downstream side and is configured to receive from the upstream side the individual separated sheets in an upper-lower relationship, stack the individual sheets and individually feed one-up sheets from the stack through the downstream side, the stacking module including:

a pneumatic assembly mounted in proximity to a sheet feeding end of the stacking module operative to feed individual sheets from the stack, the pneumatic assembly including:

an outer rotatably mounted feed drum having an outer and inner circumference and a plurality of suction openings extending between the inner and outer circumferences;

an inner vane cylinder having an outer and inner circumference with a vane cutout portion extending between its outer and inner circumference wherein the inner vane cylinder is received within the inner circumference of the feed drum such that the vane cutout portion is in communication with the suction openings of the feed drum; and a rotating inner valve cylinder having an outer and inner circumference with a valve cutout portion extending between its outer and inner circumference rotatably received within the inner vane drum, whereby when the valve cylinder is rotated such that its valve cutout portion is in communication with the vane cutout portion, and a vacuum is applied to the inner circumference of the valve cylinder, air is caused to be suctioned downward through the suction openings of the feed drum so as to cause a sheet on the bottom of the paper stack to adhere against the rotating feed drum and convey away from the sheet stack.

12. An input system as recited in claim 11, wherein at least one of the guide rails in the stacking module includes at least one air nozzle for discharging air toward the sheet stack so as to facilitate separation of a lowermost sheet in the sheet stack.

13. An input system as recited in claim 11 wherein the stacking module further includes a sensor located intermediate the feed drum and the sheet feeding end of the stacking module for detecting passage of fed sheets from the sheet stack.

14. An input system as recited in claim 11, wherein at least a portion of the outer circumference of the feed drum in the stacking module is coated with Mearthane.

15. An input system as recited in claim 11, wherein the feed drum of the stacking module is operatively connected to a first motor operative to provide continues rotation of the feed drum.

16. An input system as recited in claim 15, wherein the inner vane cylinder of the stacking module is rotatably adjustable relative to the feed drum such that the position of the vane cutout portion is adjustably, through rotation of the inner valve cylinder, relative to the suction openings of the feed drum.

17. An input system as recited in claim 16, wherein the inner valve cylinder of the stacking module is operatively connected to a second motor operative to provide rotation of the feed drum between a default position wherein the valve cutout portion is not in communication with the vane cutout portion and an actuated position wherein the valve cutout portion is in communication with the vane cutout portion.

18. An input system as recited in claim 17, wherein the inner valve cylinder of the stacking module is coupled to a vacuum source drawing a constant vacuum in the inner circumference of the inner valve cylinder such that when the inner valve cylinder is positioned in the actuated position air is caused to be drawn downward through the suction openings in the rotating feed drum.

* * * * *